United States Patent [19]

Locher

[11] Patent Number: 4,817,898

[45] Date of Patent: Apr. 4, 1989

[54] ADJUSTING DEVICE, PARTICULARLY FOR ADJUSTABLE CHAIRS

[75] Inventor: Hermann Locher, Dornach, Switzerland

[73] Assignee: Giroflex Entwicklungs AG, Koblenz, Switzerland

[21] Appl. No.: 48,028

[22] Filed: May 11, 1987

[30] Foreign Application Priority Data

May 15, 1986 [CH] Switzerland ..... 01971/86

[51] Int. Cl.[4] ..... F16F 9/32

[52] U.S. Cl. ..... 248/161; 248/631; 267/64.12; 188/300

[58] Field of Search ..... 248/631, 651, 669, 161, 248/162.1, 404, 157, 188.5, 354.1; 297/345, DIG. 3, 355; 188/300, 319; 267/64.12

[56] References Cited

U.S. PATENT DOCUMENTS

| | | | |
|---|---|---|---|
| 2,953,223 | 9/1960 | Dillenburger | 188/313 X |
| 3,223,206 | 12/1965 | Bainbridge | 188/300 |
| 3,388,883 | 6/1968 | Axthammer | 188/300 X |
| 3,547,394 | 12/1970 | Wehner | 297/345 X |
| 3,762,514 | 10/1973 | Freitag | 248/354.1 X |
| 3,787,019 | 1/1974 | Freitag | 248/354.1 X |
| 4,124,207 | 11/1978 | Hatakeyama | 188/300 X |
| 4,307,874 | 12/1981 | Reuschenbach | 188/300 X |
| 4,337,850 | 7/1982 | Shimokura | 188/319 |
| 4,373,707 | 2/1983 | Moldens | 267/64.12 |
| 4,632,228 | 12/1986 | Oster | 188/300 X |

FOREIGN PATENT DOCUMENTS

| | | | |
|---|---|---|---|
| 1505360 | 3/1970 | Fed. Rep. of Germany | 188/313 |
| 2178508 | 2/1987 | United Kingdom | 188/322.15 |

*Primary Examiner*—J. Franklin Foss
*Assistant Examiner*—Robert A. Olson
*Attorney, Agent, or Firm*—Werner W. Kleeman

[57] ABSTRACT

The adjusting device possesses a hydraulic cylinder in whose cylinder tube there are housed a main piston equipped with a piston rod, an auxiliary piston and a force-exerting spring. The cylinder tube is closed off at both of its ends by an associated end flange. The outer surface of the cylinder tube simultaneously constitutes the guide surface of a guide tube which is fixedly connected by means of a connecting flange with the piston rod. Since the cylinder tube possesses an essentially constant or uniform inner diameter and outer diameter, the guide tube can be constructed to be so long that the adjusting device is stable enough to serve as a supporting column or pillar, e.g. for a chair or other seat structure.

6 Claims, 1 Drawing Sheet

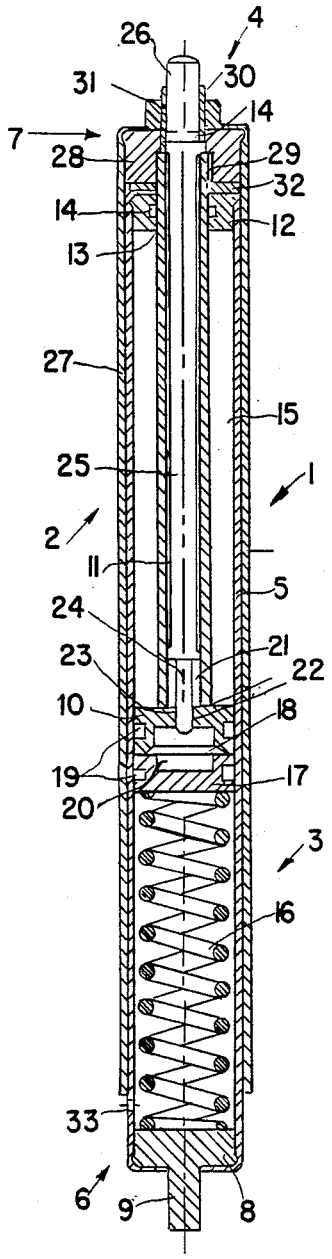
4
26
30
31
14
7
28
29
32
14
12
13
27
15
25
1
2
11
5
24
21
23
22
10
18
19
17
20
3
16
33
6
9
8

ADJUSTING DEVICE, PARTICULARLY FOR ADJUSTABLE CHAIRS

CROSS REFERENCE TO RELATED APPLICATIONS

This application is related to my commonly assigned, copending U.S. patent application Ser. No. 06/780,825, filed Sept. 27, 1985, and entitled "CHAIR WITH REARWARDLY INCLINABLE SEAT AND BACK REST CARRIER", now U.S. Pat. No. 4,684,173, granted Aug. 4, 1987; and to my commonly assigned, copending U.S.patent application Ser. No. 06/795,500, filed Nov. 6, 1985, and entitled "ADJUSTING MECHANISM, PARTICULARLY FOR TILTABLE AND VERTICALLY ADJUSTABLE CHAIRS" now abandoned.

BACKGROUND OF THE INVENTION

The present invention relates to a new and improved construction of an adjusting or adjustment device, particularly for articles of furniture, and especially, although not exclusively, for adjustable chairs or the like.

In its more specific aspects, the present invention relates to a new and improved construction of an adjusting or adjustment device with a lifting unit or appliance which is composed of a hydraulic cylinder and a piston or main piston equipped with a piston rod, for coupling and force impingement of two parts or components which are movable relative to one another, particularly for adjustable chairs, wherein one part is connected with the cylinder and the other part is connected with the piston rod. The main piston is loaded, on the one hand, by means of a flowable or fluent medium, and the lift or stroke of the lifting unit or appliance is adjustable by means of a control device or mechanism slidingly guided in the piston rod.

A particularly preferred field of application for adjusting devices of the type described above is represented by seats and chairs adjustable for height and inclination, as used in many different environments or areas, for example, in the office, in the home, on a ship, and in vehicles of all types. The adjusting devices are usually hydraulic cylinders, whose pistons are additionally acted upon by a force-exerting spring. For the momentary adjustment there is provided a control device or mechanism which is usually manually operated.

An adjusting or adjustment device of the aforementioned type has been disclosed by the inventor and assignee of this application in the European Published Patent Application No. 176,816 and in the aforementioned commonly assigned, copending United States application Ser. No. 06/795,500, filed Nov. 6, 1985 which is likewise employed for adjustable seats and chairs. This adjusting device possesses a cylinder and a piston with a piston rod and guide rod. In a longitudinal bore of the piston, a control piston is slidably or displaceably guided, so that channels arranged in the piston can be thereby interrupted or released. The inner volume of the cylinder is completely filled with a flowable or fluent grease or lubricant. The adjusting device is firmly positionally fixed when the channels are blocked and can move when these channels are released or freed. The use of a flowable or fluent grease or lubricant permits a very exact and unaltered maintenance of a once adjusted position.

This adjusting or adjustment device has already proven itself in practice in many fields of application.

However, its use or application is limited in that the total lift or stroke of the adjusting device is relatively small and amounts to only a few centimeters, e.g. about 5 to 6 centimeters. This lift or stroke is sufficient for many applications or uses, however there are fields of application or uses, particularly for chairs, where a lift or stroke of at least about 10 cm is demanded from the adjusting or adjustment device.

SUMMARY OF THE INVENTION

Therefore with the foregoing in mind, it is a primary object of the present invention to provide a new and improved construction of an adjusting or adjustment device, particularly for adjustable chairs, which does not exhibit the aforementioned drawbacks and shortcomings of the prior art constructions.

Another and more specific object of the present invention aims at the provision of a new and improved construction of an adjusting or adjustment device which constitutes an improvement upon the previously described adjusting device such that it exhibits an appreciably greater lift or stroke, that is to say, a lift or stroke which is at least twice as great, while maintaining an exact setting or adjustment, even over long periods of time.

Still a further significant object of the present invention is directed to a new and improved construction of an adjusting device, particularly for articles of furniture, and especially although not exclusively for adjustable chairs, which adjusting device is relatively simple in construction and design, quite economical to manufacture, extremely reliable in operation, extremely easy to use, affords an exact setting of the related article of furniture throughout a relatively long lift or stroke, maintains the set or adjusted position over long periods of time without deviation, is not readily subject to breakdown or malfunction, and requires a minimum of maintenance and servicing.

Now in order to implement these and still further objects of the invention, which will become more readily apparent as the description proceeds, the adjusting or adjustment device of the present invention is manifested by the features that the cylinder is equipped with a cylinder tube exhibiting an essentially constant inner diameter and outer diameter over its length. The force-exerting spring is constructed as a helical compression spring which is supported at one end at the lower or bottom end wall of the cylinder tube which is devoid of or remote from the piston rod, in other words, such lower or bottom end wall of the cylinder tube is disposed at a side remote from the piston rod. The other end of the helical compression spring is supported at a freely-movable piston or auxiliary piston. At the side of this freely-movable piston or auxiliary piston which faces away from the force-exerting spring, a space or chamber is formed by the volume enclosed between the freely-movable auxiliary piston and the main piston. This space or chamber is connected by means of the control device or mechanism with the cylinder space or chamber located on the side of the piston rod.

BRIEF DESCRIPTION OF THE DRAWINGS

The invention will be better understood and objects other than those set forth above will become apparent when consideration is given to the following detailed description thereof. Such description makes reference to the annexed drawing wherein the single FIGURE thereof shows in schematic illustration a longitudinal section of an adjusting or adjustment device constructed according to the present invention.

DETAILED DESCRIPTION OF THE PREFERRED EMBODIMENTS

Describing now the drawings, it is to be understood that to simplify the showing thereof, only enough of the construction of the adjusting or adjustment device has been illustrated therein as is needed to enable one skilled in the art to readily understand the underlying principles and concepts of the present invention. Furthermore, as to details of the manner in which the adjusting or adjustment device of the present invention can be used in the environment of an adjustable chair reference is made to the aforementioned European Published Patent Application No. 176,816 and the aforementioned United States application Ser. Nos. 06/780,825, (now the aforementioned U.S. Pat. No. 4,684,173) and 06/795,500, now abandoned.

Turning now specifically to the single figure of the drawing, the structure illustrated therein by way of example and not limitation will be seen to comprise an adjusting or adjustment device, generally designated in its entirety by reference numeral 1, and suitable for use as, for example, the column or pillar or post of a chair, which is rotatably supported at its bottom end or base by a base frame, or pedestal, which may be optionally constructed to be mobile, and which is fixedly connected at its upper end to a support or supporting structure to which there are attached the seat part and the backrest. The adjusting or adjustment device 1 essentially comprises a hydraulic cylinder 2 of a special construction as the same will be discussed more fully hereinafter, a force-exerting spring 3 and a control mechanism or device 4.

The hydraulic cylinder 2 possesses a cylinder tube 5 which exhibits an essentially uniform or constant wall thickness throughout its entire length. The cylinder tube 5 possesses such a length that the force-exerting spring 3 can be appropriately housed therein. The cylinder tube 5 is closed off at its bottom or lower end 6 containing the force-exerting spring 3 by an end flange or sleeve 8 which carries at its outer side or face a journal or pin 9, preferably of substantially cylindrical shape. By means of the journal or pin 9, the adjusting or adjustment device 1 can be fastened onto, say, a base frame or pedestal, and the fastening or attachment can take place by means of a not particularly illustrated but conventional pivot bearing mounted upon the journal or pin 9. This lower or bottom end flange or sleeve 8 is connected at the lower or bottom end 6 of the cylinder tube 5 by means of a flanged portion with the cylinder tube 5, although this connection can also be made in another way, for example by welding or by threaded means. The journal or pin 9 can also be replaced by another suitable connecting means, for example a threaded bore provided in the lower or bottom end flange 8.

Subsequent to or forwardly of the force-exerting spring 3 a main piston or piston member 10 is slidably or displaceably guided in the cylinder tube 5. This main piston 10 is connected on the side facing away from the force-exerting spring 3 with a piston rod or rod member 11.

The cylinder tube 5 is closed off at its upper or top end 7 by means of an upper or top end flange or sleeve 12, which, for example, is connected by means of a flanged portion with the cylinder tube 5. An alternative form of connection, for example by welding or threaded means, of the upper or top end flange or sleeve 12 with the cylinder tube 5 is also possible. This upper or top end flange or sleeve 12 possesses a bore or bore hole 13 through which the piston rod 11 extends. A groove 14 in the bore or bore hole 13 serves to receive a suitable and therefore not particularly shown sealing element, for example an elastic O-ring or similar sealing expedient, with which the cylinder space or chamber 15 on the side of the piston rod 11 is sealed from the outside.

The force-exerting spring 3 is preferably constructed, for instance, as a compression spring, of which one end is supported at the lower or bottom end flange or sleeve 8 and the other end at an auxiliary piston or piston member 17 which is slidably or displaceably guided in the cylinder tube 5. The auxiliary piston 17 delimits or bounds a cylinder space or chamber 18 on the side of the main piston 10, and both the main piston 10 as well as the auxiliary piston 17 are provided with a respective groove 19 on the related outer circumference or surface, which serves to receive a suitable associated sealing element, for example an elastic O-ring. In each of the two pistons or piston members 10 and 17 there are provided recesses or pockets 20 which are directed in facing relationship towards one another. These confronting recesses or pockets 20 collectively form the cylinder space or chamber 18 at the side of the pistons 10 and 17 in the end or terminal position of the adjusting device 1 illustrated in the single FIGURE. In the main piston 10 and in the piston rod 11, there is provided a connection between the cylinder space or chamber 15 on the side of the piston rod 11 and the cylinder space or chamber 18 on the side of the main piston 10 confronting the auxiliary piston 17. In the piston rod 11, which exhibits a longitudinal bore 21, there are arranged in the region of the main piston 10 radial bores 22 serving as a connection or flow communication between the cylinder space or chamber 15 on the side of the piston rod 11 and the longitudinal bore 21, while an axial bore 23 is located in the base or floor of the main piston 10 and serves as a connection or flow communication between the longitudinal bore 21 and the cylinder space or chamber 18 on the side of the main piston 10.

The axial bore 23 forms together with a control piston 24 a control element for operating the adjusting or adjustment device 1. In this regard the control piston 24 is part of an actuating or operating bar or rod 25 which is guided in the longitudinal bore 21 of the piston rod 11 and which projects out of the piston rod 11 with its upper or top end 26 which exhibits a sealing groove 14. At that location there engages a not particularly illustrated but conventional actuation lever or equivalent structure by means of which the connection between both cylinder spaces or chambers 15 and 18 can be opened and closed.

At the outer circumference or surface of the cylinder tube 5 there is guided for lengthwise or longitudinal motion a guide tube or tube member 27 which is provided at its upper end with a connecting or connection flange or sleeve 28. The connecting or connection flange 28 possesses a bore or bore hole 29, by means of which the connecting flange 28 can be inserted onto the upper or top end 30 of the piston rod 11 and threadably connected thereto by means of a nut 31 or equivalent structure. Therefore, with the movement of the main piston 10, the guide tube 27 is also moved. An elastic washer or disk 32, for example a rubber washer, is positioned as a buffer between the connecting flange 28 and the upper or top end flange or sleeve 12.

The two cylinder spaces or chambers 15 and 18 are filled with a suitable hydraulic fluid or fluid medium, in this case advantageously a so-called flowable or fluent grease or lubricant, for example OSSAGOL V from Shell Corporation or another similar flowable grease or lubricant. What is important is that this flowable grease or lubricant stays flowable or fluent, i.e. forms no droplets or drops, throughout a large temperature range, for example from −30° C. to +70° C. The lubricant or grease volume is chosen to be so large that the helical compression spring 16 is prebiased. If the operating bar or rod 25 of the control device or mechanism 4 is now released by means of the not particularly illustrated operating lever, then the operating bar or rod 25 is lifted in the hydraulic cylinder 2 by means of the pressure exerted by the compression spring 16, whereby the connection between the two cylinder spaces or chambers 15, 18 is opened. Consequently, the main piston 10 is moved together with the guide tube 27 for such length of time until the main piston 10 abuts against the upper or top end flange 12. In order to move position depicted in the drawing, a force must be exerted on the connecting flange 28 from the outside, and there is to be simultaneously ensured that the operating bar or rod 25 can be lifted and that thereby the connection or flow communication between the two cylinder spaces or chambers 15 and 18 is opened.

The described adjusting or adjustment device 1 is simple in its construction, since a single tube, namely the cylinder tube 5, is used for housing or receiving the force-exerting spring 3 and the hydraulic cylinder 2. In this way, it is also possible to construct the guide tube 27 to be very long in its length, so that the adjusting or adjustment device 1 is stable enough to be used directly as a pillar or column or post, for example for a seat or a chair.

The guide tube or tube member 27 can possess a length which corresponds approximately to the length of the cylinder tube 5 and which extends so far in the end or terminal position of the adjusting device 1 shown in the drawing that an air vent or pipe 33 is still just directly exposed or free.

While there are shown and described present preferred embodiments of the invention, it is to be distinctly understood that the invention is not limited thereto, but may be otherwise variously embodied and practiced within the scope of the following claims. Accordingly,

What I claim is:

1. An adjusting device, comprising:

a hydraulic cylinder;

a main piston reciprocatingly mounted in said hydraulic cylinder;

a piston rod provided for said main piston;

said hydraulic cylinder containing a cylinder chamber located at a side of the main piston provided with said piston rod;

a force-exerting spring for loading said main piston;

a flowable medium for loading said main piston;

a control device displaceably guided in said piston rod;

said hydraulic cylinder comprising a cylinder tube;

said cylinder tube possessing a substantially constant inner diameter and outer diameter;

said force-exerting spring comprising a compression spring;

said compression spring having opposed ends;

said cylinder tube having a lower end flange disposed remote from said piston rod;

a freely movable auxiliary piston member arranged in said hydraulic cylinder and located in neighboring relationship to said main piston;

one end of said opposed ends of said compression spring bearing upon said lower end flange of said cylinder tube which is disposed remote from said piston rod;

the other end of said opposed ends of said compression spring bearing upon said freely movable auxiliary piston member;

said freely movable auxiliary piston member having a side facing away from said compression spring and forming together with said main piston a chamber;

said control device operatively connecting said chamber with said cylinder chamber located at the side of the main piston provided with said piston rod;

said piston rod possesses a longitudinal bore;

said control device comprising an actuating rod guided for lengthwise movement in said longitudinal bore;

said actuating rod having a diameter;

said control device comprising a control piston arranged at the actuating rod at an end of the longitudinal bore located at the side of the main piston;

said control piston having a smaller diameter than the diameter of the actuating rod;

said main piston having an axial bore;

said control piston serving for opening and closing said axial bore of said main piston;

said piston rod being provided with radial bores disposed transversely to said longitudinal bore; and said axial bore forming by means of said radial bores of the piston rod a connection between said cylinder chamber and said chamber.

2. The adjusting device as defined in claim 1, wherein:

said cylinder tube has an outer wall;

a guide tube guided on said outer wall of said cylinder tube; and means for connecting said guide tube with said piston rod.

3. The adjusting device as defined in claim 2, wherein:

said connecting means comprises a connection flange; and means for centering and fixedly clamping said connection flange upon said piston rod.

4. The adjusting device as defined in claim 3, wherein:

said means for centering and fixedly clamping said connection flange upon said piston rod comprises a threaded nut.

5. The adjusting device as defined in claim 2, wherein:

said guide tube possesses a length corresponding approximately to the length of the cylinder tube.

6. The adjusting device as defined in claim 3, further including:

an upper end flange provided for the cylinder tube at the side of the piston rod; and an elastomeric disk embedded between the upper end flange of the cylinder tube and the connection flange.

* * * * *